US005426894A

United States Patent [19]

Headrick

[11] Patent Number: 5,426,894

[45] Date of Patent: Jun. 27, 1995

[54] CONTINUOUS SIDELIGHT SILL WITH ADAPTABLE THRESHOLD CAPS

[76] Inventor: J. Charles Headrick, 5775 Bethelview Rd., Cumming, Ga. 30130

[21] Appl. No.: 160,975

[22] Filed: Dec. 3, 1993

Related U.S. Application Data

[63] Continuation-in-part of Ser. No. 5,621, Mar. 8, 1993.

[51] Int. Cl.[6] ..... E06B 1/70

[52] U.S. Cl. ..... 49/468; 49/467; 49/471; 52/204.1; 52/207

[58] Field of Search ..... 52/204.1, 204.51, 207; 49/467, 468 R, 471

[56] References Cited

U.S. PATENT DOCUMENTS

| | | | |
|---|---|---|---|
| 1,697,200 | 1/1929 | Morgana et al. . | |
| 2,078,126 | 4/1937 | Cusick . | |
| 2,290,472 | 7/1942 | Hendrick . | |
| 2,332,579 | 10/1943 | Kirby . | |
| 2,482,977 | 9/1949 | Hendrick . | |
| 3,029,782 | 4/1962 | Eure . | |
| 3,083,420 | 4/1963 | Tinflow . | |
| 3,380,435 | 4/1968 | Wagner . | |
| 3,667,192 | 6/1972 | Sewell | 49/467 X |
| 3,774,343 | 11/1973 | Cribben et al. | 49/467 |
| 3,900,967 | 8/1975 | Bursk et al. | 49/468 |
| 4,193,375 | 3/1980 | Sharland et al. . | |
| 4,224,766 | 9/1980 | Procton | 49/468 |
| 4,341,828 | 7/1982 | Stephens . | |
| 4,352,258 | 10/1982 | Bursk et al. | 49/468 |
| 4,357,898 | 11/1982 | Fehrenbacher . | |
| 4,398,495 | 8/1983 | Harris, Jr. et al. . | |
| 4,449,267 | 5/1984 | Siemion . | |
| 5,001,865 | 3/1991 | Procton . | |
| 5,136,814 | 8/1992 | Headrick . | |
| 5,179,804 | 1/1993 | Young | 49/468 X |
| 5,230,181 | 7/1993 | Geoffrey et al. . | |
| 5,230,738 | 7/1993 | Wheeler . | |
| 5,283,977 | 2/1994 | Smith . | |

*Primary Examiner*—Carl D. Friedman
*Assistant Examiner*—Wynn E. Wood
*Attorney, Agent, or Firm*—Hopkins & Thomas

[57] ABSTRACT

A continuous sidelight threshold and door sill assembly for use with entryways having at least one fixed sidelight panel and a hinged door panel comprises an extruded aluminum frame having an elongated channel and a sloped sill. A vertically adjustable threshold cap is shorter than the channel is configured to fit in and be selectively positioned at a predetermined location along the channel. A separate panel cap is also configured to fit in the channel and be selectively positioned therealong. The assembly is universally adaptable to be used either with left handed, right handed, or double sided sidelight door entryways simply by positioning the threshold cap and the panel cap at respective appropriate locations along the channel. Also, the threshold and sidelight caps preferably are formed from extruded plastic material and can be easily cut and fitted to virtually any entryway configuration.

15 Claims, 2 Drawing Sheets

CONTINUOUS SIDELIGHT SILL WITH ADAPTABLE THRESHOLD CAPS

REFERENCE TO RELATED APPLICATION

This application is a continuation-in-part of U.S. patent application Ser. No. 29/005,621 filed Mar. 8, 1993.

TECHNICAL FIELD

This invention relates generally to threshold and door sill assemblies and more particularly to door sill assemblies for installation beneath an entryway having at least one fixed sidelight panel and a hinged door panel.

BACKGROUND OF THE INVENTION

Decorative entryways into homes and buildings have long been popular among builders and owners alike. In one common configuration of such an entryway, a door that is hinged to be opened and closed is flanked by one or more decorative sidelight panels. In some instances, these sidelight panels are paned with cut or colored glass. In other cases, wooden sidelight panels may be used to flank the door and add dimension and decoration to the entryway. Patio entryways having one fixed door and one openable door hinged either to the left or right of the fixed door are also common. In either case, the common attribute of such entryways is that they include at least one and usually two fixed sidelight panels and at least one hinged door panel.

Providing a reliable and stable threshold and door sill at the bottom of such multi-panel entryway assemblies has proven to be something of a challenge to their manufacturers. In some instances, the entire assembly, including door jambs, door, sidelight frames, and sidelights are built upon a heavy wooden base plate. In these cases, the fixed sidelight panels rest directly on the base plate and are sealed as well as possible in sidelight frames that are formed by the jambs of the assembly. Then, a common wooden or extruded aluminum door sill is installed on the base plate extending between the door jambs beneath the closed door to provide a seal against the bottom of the door.

While this construction technique is somewhat adequate, it nevertheless is plagued with various problems and shortcomings. For example, since the sidelights rest directly on the wooden base plate, rainwater, over time, tends to run down the fixed sidelight panels, seep into the base plate, and cause rotting that eventually necessitates replacement of the entire entryway assembly. The base plate can also warp over time. Further, the aluminum or wooden door sill, which terminates against the bottoms of the door jambs, tends to leak at its ends as rainwater runs down the door jambs and works it way beneath the ends of the sill and onto the wooden base plate below.

Some manufacturers of multi-panel entryway assemblies have addressed these types of problems by purchasing aluminum door sill assemblies long enough to span the entire width of the entryway and underlie both the fixed panels and the hinged door. The sill is then installed along the entire length of a wooden base plate and the door frame, sidelight frames, sidelights, and door are assembled atop the sill. While this approach indeed reduces water seepage beneath the door sill, it too has had numerous inherent problems.

For example, it is desirable with such assemblies that the continuous sill be provided with a vertically adjustable threshold cap positioned to underlie the closed door of the entryway and vertically fixed and structurally sturdy panel caps positioned to underlie the fixed sidelight panels. In the past, such threshold and sill assemblies have by necessity been custom manufactured to fit a particular entryway configuration. This has been due, in part, to the fact that vertical adjustment means of prior art sills have been operatively integrated into the sill frame itself so that the threshold cap is necessarily fixed in a given longitudinal location along the sill. Thus, the threshold cap has been custom cut to length and fitted on the sill frame in the proper location to underlie the closed door. If the size or location of the door changed, new custom sized sill assemblies were necessary to fit the new configuration. In short, prior art continuous threshold and sill assemblies for multi-panel entryways have not been adaptable to changing entryway configurations. This problem has been particularly acute in the case of two door patio entryways. These types of entryways can include either a left-hand swing door or a right-hand swing door. Accordingly, manufacturers have had to stock custom made threshold and sill assemblies with the vertically adjustable threshold cap located both on the left and right of the sill frame. Further, different sizes have had to be stocked for different size door panels. Clearly, the inventory expense and waste of stocking so many custom made parts can be substantial.

Some entryway manufacturers have attempted to solve these problems by purchasing threshold and sill assemblies having a vertically adjustable threshold cap extending the entire length of the sill frame. The threshold cap is then cut into appropriate length sections and the sections that are to underlie the fixed sidelight panels are permanently vertically adjusted before the fixed sidelight panels are installed and sealed in place. While this approach provides a bit more adaptability and reduces the need for custom manufactured sill assemblies, it nevertheless is labor intensive and relatively expensive since an adjustable threshold cap must be paid for even for use under fixed sidelight panels where adjustment is not required.

It can thus be seen that there exists a continuing and heretofore unaddressed need for a continuously running door sill and threshold cap assembly for use with sidelight and patio entryways that eliminates the need for custom sized assemblies by having both vertically fixed and vertically adjustable threshold caps that can be positioned anywhere along the length of the sill frame and thus that are fully adaptable to a wide variety of entryway sizes and configurations. The assembly should be economical to produce, easy to adapt in the field, and provide for superior drainage of rainwater away from both the fixed sidelight panels and the hinged door panel. It is to the provision of such a threshold and door sill assembly that the present invention is primarily directed.

SUMMARY OF THE INVENTION

Briefly described, the present invention, in one preferred embodiment thereof, comprises a continuously extending, fully adaptable threshold and door sill assembly for installation in entryways having at least one fixed sidelight panel and an openable hinged door panel. The assembly comprises an elongated extruded aluminum frame formed with an elongated upwardly open channel and a sill that slopes away and downwardly from one side of the channel. An extruded plastic threshold cap is sized and configured to be received and supported within the channel with at least a portion of the threshold cap protruding upwardly from the channel. The threshold cap has a length less than the length of the channel and can be slid longitudinally within the channel to any desired position therealong. The threshold cap is vertically adjustable at any selected location within the channel and is adapted to rest beneath the hinged door of an entryway when the door is closed.

At least one separate panel cap, which also preferably is formed from extruded plastic, is sized and configured to fit in the channel and protrude upwardly a predetermined distance therefrom. The panel cap is fixed in vertical height and, like the threshold cap, can be slid longitudinally within the channel to any desired location therealong. When installed in an entryway, the panel cap is positioned beneath a fixed sidelight panel or beneath the fixed door of a patio entryway, which rests on the panel cap and is sealed in place within a sidelight panel frame.

The upwardly open channel formed in the aluminum frame is generally U-shaped, having a floor and spaced front and rear walls that extend upwardly from the floor. The walls terminate in upper rims. Both the threshold cap and the panel cap are formed with downwardly extending lips that overlap the front wall rim and extend downwardly toward the sloped sill of the assembly. In this way, rainwater is kept out of the channel and directed away from the door and sidelight panels by the overhanging lips of the threshold and panel caps.

In use, the threshold and sill assembly of this invention is extremely versatile because of its easy adaptability to just about any entryway configuration. An entryway manufacturer need only stock the basic aluminum sill and a variety of different length threshold and panel caps. To create a threshold and sill for a particular entryway configuration, the manufacturer simply selects the proper size threshold and panel caps, snaps them into the sill channel, and positions them at the appropriate longitudinal positions along one channel. If necessary, the extruded plastic caps can be cut to length to conform to virtually any entryway configuration. Further, in entryways with only one sidelight, the manufacturer need not stock both left handed and right handed sill assemblies. This is because the threshold and panel caps of the present invention can be slid to any desired position along the channel to create either a right or left handed sill with the very same parts.

Thus, the present invention embodies an improved threshold and sill assembly for installation beneath sidelight or patio entryways that addresses and solves the problems inherent in the prior art. Specifically, with this invention, the need to stock custom manufactured parts is eliminated because the present invention is fully adaptable to virtually any entryway configuration. It is inexpensive to manufacture, economical to stock, and easy to use. Superior rainwater drainage is an added benefit. These and many other objects, features, and advantages of the present invention will become more apparent upon review of the detailed description set forth below taken in conjunction with the accompanying drawings, which are briefly described as follows.

DETAILED DESCRIPTION OF THE PREFERRED EMBODIMENT

Figure 1:
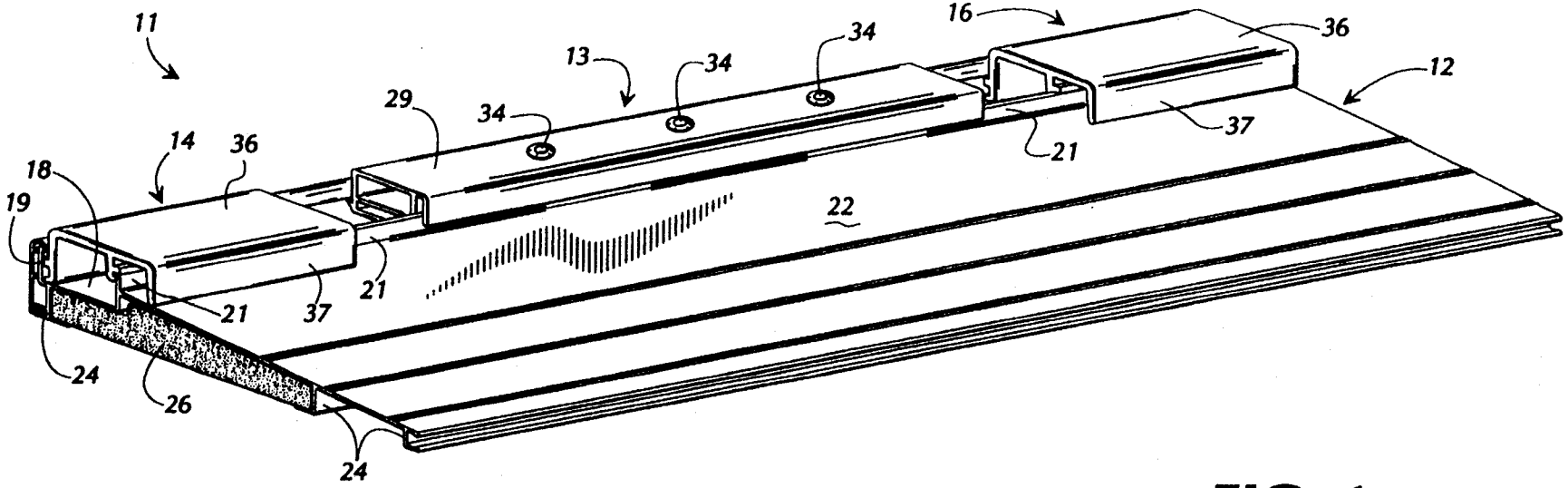
FIG. 1 is a perspective view of a sidelight threshold and sill assembly that embodies principles of the present invention in a preferred form.
Figure 2A:
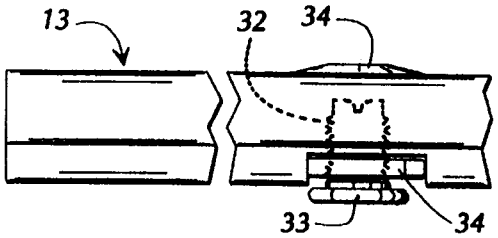
FIG. 2A is a front elevational view of the threshold cap of this invention showing the vertical adjustment means thereof.
Figure 2:
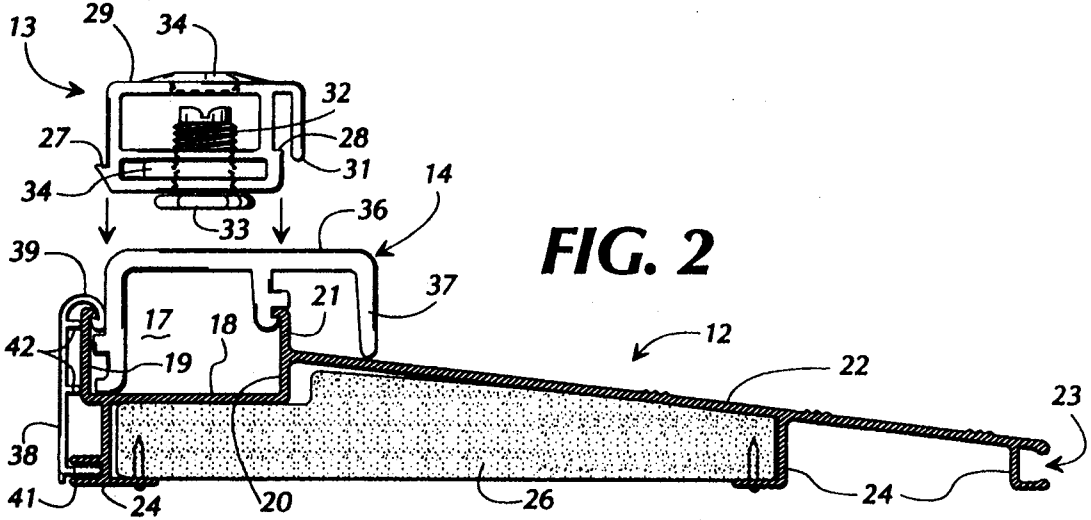
FIG. 2 is a side elevational view of the assembly of FIG. 1 showing the channel, sloped sill, panel cap, and vertically adjustable threshold cap.

Referring now in more detail to the drawings, wherein like numerals refer to like parts throughout the several views, FIGS. 1–2A illustrate a threshold and door sill assembly that embodies principals of the present invention in a preferred form. The assembly 11 is intended for use as the threshold and door sill of a double sidelight entryway having a hinged door flanked by fixed sidelight panels. The assembly comprises an elongated extruded aluminum frame 12, a threshold cap 13, and panel caps 14 and 16, respectively. Frame 12 is formed to define a substantially U-shaped upwardly open channel 17 (FIG. 2) having a floor 18, a rear wall 19, and a forward wall 21. The frame is further formed to define a sill 22 that extends forwardly and slopes downwardly from the forward wall 20 of the channel 17. The sill 22 terminates in a forward edge 23. The entire frame 12 rests and is supported upon a set of depending pads 24. Rigid plastic blocks 26 are secured in place on the underside of the frame as shown to add strength and rigidity to the structure.

The threshold cap 13, which, in use, underlies the hinged door of the entryway when the door is closed, preferably is formed of extruded plasticized material that is aesthetically pleasing yet resistant to wear, tear, warping, and rotting. The threshold cap is configured to have an elongated body that is sized and shaped to fit snugly but removably into the channel 17 defined by the frame 12 as best seen in FIG. 1. Specifically, the upper edges of channel walls 19 and 20 are formed with slightly inwardly extending tangs and the threshold cap 13 is formed with corresponding outwardly extending ledges 27 and 28 (FIG. 2). The ledges 27 and 28 are formed with downwardly tapered upper surfaces as seen in FIG. 2. With this configuration, the threshold cap 13 can easily be snapped downwardly into place in the channel 17 where it is held snugly by the ledges 27 and 28, resting under the tangs of the channel. However, if it becomes necessary to remove the threshold cap 13 once the assembly is in place in an entryway, the cap can be grasped firmly with an appropriate tool and pulled upwardly. When this is done, the sloped upper surfaces of the ledges 27 and 28 engage the tangs of the channel and cause the channel walls to spread enough to allow the removal of the cap 13. A new cap can then simply be snapped into place. Thus, the entire threshold cap can easily and conveniently be replaced in the field if it becomes damaged or otherwise requires replacement.

The threshold cap 13 is further configured to have a top surface 29 and a downwardly extending lip 31 that is formed integrally with the body of the threshold cap and depends downwardly from the front edge of its top surface 29. With this configuration, it can be seen from FIG. 1 that when the threshold cap 13 is positioned within the channel 17, at least a portion of the threshold cap protrudes upwardly from the channel. Further, when thus positioned, the depending lip 31 of the threshold cap overhangs the rim 21 of the channel's forward wall 20 and extends downwardly toward the surface of the sill 22. In this way, rain water and other moisture that may collect or run onto the threshold cap 13 is directed over the lip 31 and onto the sill 22, where it flows down the sill and away from the entryway. Thus, the rim 21 and lip 31 together form a substantially impervious dam that resists the migration of water into the channel 17 where it might collect and do damage.

The threshold cap 13 is vertically adjustable within channel 17 by means of a set of threaded pedestals 32 that depend from the bottom of the threshold cap and terminate in support pads 33. The pedestals 32 are each threadably received in a corresponding threaded lug 34 that, in turn, is captured in a slot cut in the bottom of the threshold cap 13 as best seen in FIG. 2A. The upper end of the pedestals 32 are slotted so that the pedestals can be advanced into and out of their respective lugs 34 to raise and lower the vertical position of the threshold cap within the channel 17. To facilitate such adjustment, the top surface 29 of the threshold cap has access ports that are aligned with the pedestals 32 to allow appropriate adjustment with a screwdriver from the top of the threshold cap. The access ports normally are covered with caps 34, which prevent the migration of water and dirt through the access ports and into the interior portion of the threshold cap 13.

With the just described configuration, it can be seen that the threshold cap 13 rests in the channel upon the support pads 33 and the vertical position of the threshold cap within the channel can easily be adjusted by removing the caps 34 and threadably advancing or retarding the pedestals 32 as required to achieve the proper vertical position. In practice, the vertical position of the threshold cap 13 is such that the top surface 29 of the threshold cap engages a rubberized or metal flap on the bottom of the hinged door to create a seal against the escape of heat from within a dwelling through the entryway. Further, since the threshold cap 13 rests upon pedestals 32, there is no requirement that the threshold cap be located at any given position along the length of the channel 17. Rather, it freely can be slid along the channel to any desired location to adapt the assembly 11 to any particular door and sidelight size and arrangement.

The threshold cap 13 is flanked in the channel 17 by a pair of panel caps 14 and 16 respectively. When the assembly 11 is installed in a sidelight type entryway, the panel caps 14 underlie and support the sidelights. As with the threshold cap 13, the panel caps 14 and 16 are formed of extruded plasticized material and are shaped, as seen in FIG. 2, to snap in place within the channel 17. Also like the threshold cap 13, the panel caps 14 and 16 can be located at any desired longitudinal position along the length of the channel 17. As detailed more fully below, this positionability enhances the adaptability of the assembly 11 a wide variety of or changing entryway designs.

Each of the panel caps 14 and 16 is formed with a top surface 36 having a front edge from which a downwardly depending lip 37 extends. As with the threshold cap, the lip 37 in conjunction with the rim 21 of the channel front wall 20 forms a substantially impervious dam that directs rain water away from and prevents it from migrating into the channel. The panel caps 14 and 16 are not vertically adjustable but, instead, rests on the floor of the channel and the rim of its forward wall to provide a firm support on which the sidelight panels of the entryway can rest and against which they can be sealed to prevent the escape of heat from a dwelling.

In cold weather conditions, the aluminum frame 12 of the assembly 11 can conduct the cold to the rear wall 19 and rear pedestal 24 of the assembly on the inside of a dwelling structure where warm moist air usually is present. To prevent consequent condensation of moisture from the interior of the dwelling on exposed surfaces of the frame 12, a plastic moisture barrier 38 is configured to snap in place covering the interior exposed surfaces of the frame as best seen in FIG. 2. The moisture barrier 38 has a top lip 39 that overlies the top edge of the channels rear wall 19. At the bottom of the moisture barrier 38 is an inwardly extending tang 41 that is received in a corresponding slot of the rear pedestal 24. Thus, the moisture barrier 38 snaps into place with its top edge 39 covering the top edge of wall 19 and its tang 41 pressed into the channel provided in rear pedestal 24. The moisture barrier is formed with a pair of stand-offs 42 that rest on the rear wall 19 of the channel. These stand-offs maintain the moisture barrier in spaced relationship with the rear of the frame 12 to provide a substantially sealed air space between the moisture barrier and the rear of the frame. This sealed air pocket, in turn, functions efficiently to eliminate any condensation of moisture on the back of the frame and thus eliminates any risk of rotting or warping of adjacent wooden structures as a result of the condensed moisture.

In use, the threshold and sill assembly 11 usually is installed as an integral part of a sidelight entryway. When so installed, the assembly extends continuously beneath the entire entryway with the panel caps 14 and 16 underlying the fixed sidelight panels of the entryway and the adjustable threshold cap 13 underlying the closed hinged door of the entryway. With this single continuous sill arrangement, junctions where leakage of water can occur are drastically reduced and water is efficiently shed away from the entryway by the continuous sill and the threshold and sidelight caps.

More importantly, however, the arbitrary positionability of the threshold cap and sidelight caps along the length of the channel 17 renders this threshold and sill assembly highly adaptable to virtually any entryway configuration that includes at least one fixed panel and at least one hinged door panel. For example, the illustration of FIG. 1 shows the assembly configured for use with a double sidelight panel entryway. However, the assembly could be adapted in minutes to be installed in an entryway with a fixed door panel on one side of the entry and a hinged door panel on the other side. This adaptation is accomplished simply by sliding the threshold cap to the end of the assembly where the hinged door is located and placing the appropriate length panel cap on the other end of the assembly. Left-hand and right-hand patio door configurations are equally accommodated simply by moving the respective caps to the proper positions along the channel 17.

Thus, a manufacturer of sidelight and patio entryway assemblies need only stock the basic extruded aluminum frame 12 and standard or stock lengths of threshold and panel caps. If the size or configuration of an entryway changes in the course of construction, the manufacturer need only select or cut the proper length threshold and panel caps, snap them into the channel, and position them on the assembly in the appropriate location to adapt the threshold and sill to the changed entryway configuration. This adaptability represents a significant improvement over prior art systems, which generally require a custom made threshold and sill assembly for each different entryway configuration to be constructed.

Figure 3:
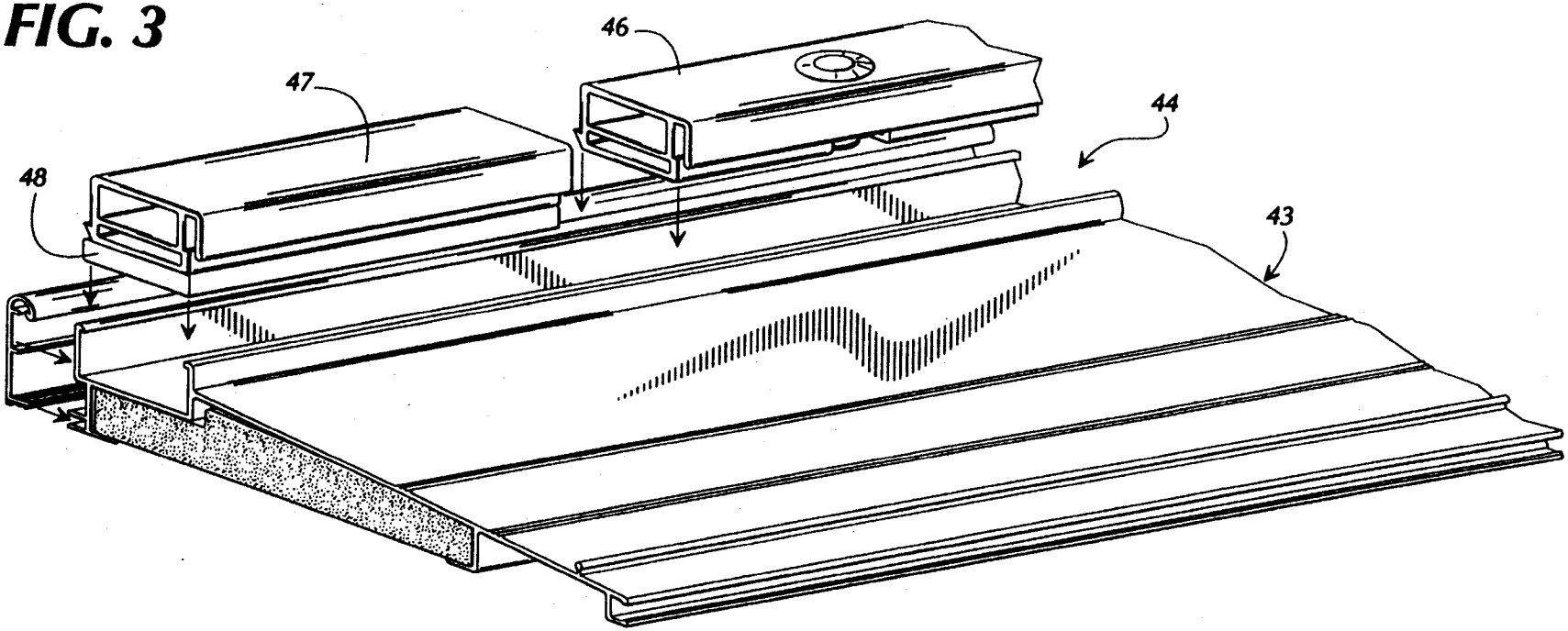
FIG. 3 is a perspective view of the end of a threshold and sill assembly that embodies principles of the invention in a second form.
Figure 4:
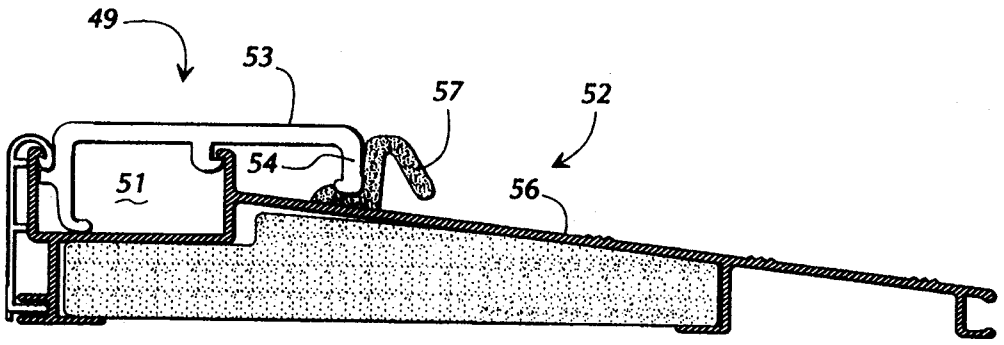
FIG. 4 is an end elevational view of an out-swing threshold and sill assembly that also bodies principles of the present invention.

FIGS. 3 and 4 illustrate slightly different embodiments of the present invention for use with various other entryway configurations. FIG. 3 shows the end portion of a threshold and sill assembly for use with a patio door entryway having one fixed door adjacent to a swinging door. The assembly has an extruded aluminum frame 43 defining a channel 44 into which a threshold cap 46 and panel cap 47 are received. The frame 43 and threshold cap 46 in this embodiment are identical to those of the embodiment shown in FIG. 1. However, the panel cap 47 here has the same general configuration as the threshold cap 46 but lacks the vertical adjustment pedestals thereon. Instead, the panel cap 47 is provided with a pad 48 that is adhesively fixed to the bottom of the panel cap and rests on the floor of the channel 44. In this way, the panel cap 47 provides a firmer foundation to support the added weight of the fixed patio door that rests on the panel cap 47. Further, the panel cap 47 and threshold cap 46 are aesthetically identical so that, when the hinged patio door is closed, there is no perceptible difference between the threshold cap that underlies the fixed door and the threshold cap hinged door. As mentioned above, this embodiment of the present invention is completely adaptable to left and right-hand swing patio doors as well as to patio door entryways of virtually any size and shape. Specifically, both the threshold and panel caps 46 and 47 can be sized and located at any desired location along the channel 44 to accommodate the particular configuration and size of the entryway with which this embodiment of the invention is to be used.

FIG. 4 illustrates an embodiment of the invention for use with swing-out entryways such as is sometimes encountered with French doors. In this embodiment, the threshold cap 49 is not vertically adjustable but is configured to snap in place within the channel 51 of the assembly 52. When snapped in place, the threshold cap is longitudinally slidable within the channel 51 to be positioned at any desired location therealong.

The threshold cap 49 is formed with a wide top surface 53 and a depending lip 54 that extends downwardly from the front edge of the top surface 53. The lip 54 extends toward the top surface of the sill 56. A foam weather strip 57 is captured between the bottom of the lip 54 and the sill 56 and is shaped as shown in FIG. 4. With this configuration, the bottom edge of the outswing doors engages and compresses the weather strip 57 against the lip 54 when the doors are closed to prevent loss of heat through the entryway. Rain water and the like running down the doors falls directly onto the sloped sill 56 and is directed away from the entryway so that it does not seep beneath the threshold and cause damage. As with the previous embodiments, the embodiments of FIG. 4 is fully adaptable to virtually any size and configuration of an out-swing doorway by the simple selection of the proper size threshold caps and the proper positioning thereof along the length of the channel 51.

The invention has been described herein in terms of preferred embodiments. It will be obvious to those of skill in this art, however, that various changes or additions could be made to the illustrated embodiments within the scope of the invention. For example, the threshold and panel caps have been described as being formed of extruded plastic. While this construction is preferred, these items could just as well be formed from other appropriate materials so that the invention is not limited to plastic or any other particular material. Also, the detailed structure of the extruded aluminum frame and the threshold and panel caps is preferred but configurations with differing details might function satisfactorily as well. These and other additions, deletions, and modifications might well be made to the illustrated embodiments without departing from the spirit and scope of the invention as set forth in the claims.

I claim:

1. An threshold and door sill assembly for installation beneath entryways having at least one fixed panel overlying a first portion of said door sill assembly and a hinged door panel that, when closed, overlies a second portion of said door sill assembly, said threshold and door sill assembly comprising:

an elongated frame member formed with a longitudinally extending upwardly open channel and a sill shaped to provide a surface that extends laterally and slopes downwardly from one side of said channel to an outside edge of said frame member;

an elongated threshold cap sized and configured to be received and supported within said upwardly open channel with at least a portion of said threshold cap protruding upwardly from said channel;

said threshold cap having a length that is less than the length of said frame member and being selectively positionable along said channel to underlie the hinged door panel of an entryway beneath which said assembly is to be installed;

an elongated panel cap sized and configured to be received and supported within said upwardly open channel with at least a portion of said channel cap protruding upwardly from said panel;

said channel cap having a length that is less than the length of said frame member and being selectively positionable along said channel to underlie the fixed panel of an entryway beneath which said assembly is to be installed; and adjustment means on said threshold cap for selective vertical adjustment of said threshold cap within said channel to provide a tight fit between said threshold cap and the bottom of the hinged door panel when the door panel is closed.

2. An threshold and door sill assembly as claimed in claim 1 and wherein said frame member is formed of extruded aluminum.

3. An threshold and door sill assembly as claimed in claim 2 and wherein said threshold cap is formed of extruded plasticized material.

4. An threshold and door sill assembly as claimed in claim 3 and wherein said panel cap is formed of an extruded plasticized material.

5. An threshold and door sill assembly as claimed in claim 4 and wherein said channel is formed with an upwardly extending rim adjacent said sill and wherein said threshold cap and said panel cap are formed with downwardly extending lips configured to overhang said rim when said threshold and panel caps are in place within said channel whereby water impinging on the threshold and panel caps is directed over said lip and onto said sill where it is shed away from the assembly.

6. An threshold and door sill assembly as claimed in claim 1 and wherein said channel has a floor, said assembly further comprising pad means fixed to the bottom of said panel cap, said pad means being sized and configured to rest on said floor of said channel to elevate said panel cap to a predetermined vertical position within said channel and provide firm support for a fixed panel overlying and resting upon said panel cap.

7. An threshold and door sill assembly as claimed in claim 1 and wherein said adjustment means comprises a set of threaded pedestals depending from and arrayed along the underside of said threshold cap with said pedestals being adapted to rest upon said channel floor and support said threshold cap thereabove, said pedestals being adapted to be threaded into and out of said threshold cap for selective adjustment of the vertical position of said threshold cap within said channel.

8. An threshold and door sill assembly as claimed in claim 7 and further comprising a set of threaded lugs mounted on the underside of said threshold cap and wherein a respective one of said pedestals is threadably secured within a corresponding one of said threaded lugs.

9. An threshold and door sill assembly as claimed in claim 8 and wherein said threshold cap is formed with slots on its underside and wherein a corresponding one of said lugs is captured and rotatably confined within each of said slots.

10. An threshold and door sill assembly as claimed in claim 7 and wherein said threshold cap is formed with access ports in its top side with said access ports being located to allow access to and appropriate manipulation of said threaded pedestals for adjusting the vertical position of said threshold cap within said channel.

11. An threshold and door sill assembly as claimed in claim 10 and further comprising a set of access port caps sized and configured to fit into and cover said access ports to prevent dirt and moisture from entering said ports.

12. An threshold and door sill assembly as claimed in claim 1 and wherein said threshold cap is sized to be positioned intermediate the ends of said channel and wherein said assembly comprises a first panel cap located in said channel on one end of said threshold cap and a second panel cap located in said channel of the other end of said threshold cap, whereby the assembly can be installed in an entryway having a central hinged door panel flanked by fixed side light panels and, when installed, the side light panels rest atop the panel caps and the hinged door panel, when closed, overlies the threshold cap.

13. An threshold and door sill assembly as claimed in claim 1 and wherein said frame member has an interior surface that faces the inside of a dwelling structure in which the assembly is installed and further comprising a moisture barrier attached to said assembly covering said interior surface, said moisture barrier being configured to provide an air space between said barrier and said interior surface of said frame member whereby the moisture barrier remains near room temperature to prevent moisture condensation thereon.

14. An out-swing door sill assembly comprising an elongated aluminum frame formed with a longitudinally extending upwardly open U-shaped channel having a floor and spaced forward and rear walls that extend upwardly from said floor to respective rims and a sill shaped to provide a surface that extends laterally and slopes downwardly from the forward wall of said channel to an outside edge of said frame member, an elongated threshold cap sized and configured to be received and supported within said channel with the threshold cap substantially covering said channel, said threshold cap having a top surface with a forward edge and a lip that depends from said top surface along the forward edge thereof, said lip being sized to overhang the forward wall of said channel and extend downwardly toward the downwardly sloped surface of said sill when said threshold cap is positioned within said channel, and an elongated weather strip having a first portion captured between said lip and said downwardly sloped surface to hold said weather strip in place and a second portion disposed in front of said lip for engaging and sealing against the bottom of an out-swing door panel when the door panel is closed.

15. An out-swing door sill assembly as claimed in claim 14 and wherein said frame member has in interior portion facing the inside of a building structure in which the assembly is installed and further comprising a moisture cap attached to and covering said interior portion, said moisture cap being configured to provide an air pocket between said moisture cap and said interior portion to inhibit conduction induced cooling of said moisture cap and consequent moisture condensation thereon.

* * * * *

UNITED STATES PATENT AND TRADEMARK OFFICE

CERTIFICATE OF CORRECTION

PATENT NO : 5,426,894

DATED : June 27, 1995

INVENTOR(S) : J. Charles Headrick

It is certified that error appears in the above-identified patent and that said Letters Patent is hereby corrected as shown below:

Claim 1, line 1, change "An" to --A--.
Claim 1, line 23, change "channel" to --panel--.
Claim 1, line 24, change "panel" to --channel--.
Claim 1, line 25, change "channel" to --panel--.
Claim 2, line 1, change "An" to --A--.
Claim 3, line 1, change "An" to --A--.
Claim 4, line 1, change "An" to --A--.
Claim 5, line 1, change "An" to --A--.
Claim 6, line 1, change "An" to --A--.
Claim 7, line 1, change "An" to --A--.
Claim 8, line 1, change "An" to --A--.
Claim 9, line 1, change "An" to --A--.
Claim 10, line 1, change "An" to --A--.
Claim 11, line 1, change "An" to --A--.
Claim 12, line 1, change "An" to --A--.
Claim 13, line 1, change "An" to --A--.

Signed and Sealed this

Fourteenth Day of April, 1998

Bruce Lehman

*Attest:*

BRUCE LEHMAN

*Attesting Officer*

*Commissioner of Patents and Trademarks*